US007702415B2

(12) United States Patent
Roos

(10) Patent No.: US 7,702,415 B2
(45) Date of Patent: Apr. 20, 2010

(54) POSITIONING OF EMBROIDERY

(75) Inventor: Lars Roos, Ulricehamn (SE)

(73) Assignee: KSIN Luxembourg II, S.AR.L, Luxembourg (LU)

( * ) Notice: Subject to any disclaimer, the term of this patent is extended or adjusted under 35 U.S.C. 154(b) by 994 days.

(21) Appl. No.: 11/443,319

(22) Filed: May 31, 2006

(65) Prior Publication Data

US 2006/0278150 A1 Dec. 14, 2006

(30) Foreign Application Priority Data

Jun. 1, 2005 (SE) ..... 0501249

(51) Int. Cl.
*D05C 5/02* (2006.01)

(52) U.S. Cl. ..... 700/138; 112/102.5; 112/456; 112/470.04; 112/475.19

(58) Field of Classification Search ..... 700/135, 700/136, 138; 112/102.5, 445, 456, 470.04, 112/470.09, 475.19
See application file for complete search history.

(56) References Cited

U.S. PATENT DOCUMENTS 5,021,965 A * 6/1991 Olbrich ..... 700/136
5,323,722 A * 6/1994 Goto et al. ..... 112/102.5
5,553,559 A * 9/1996 Inoue et al. ..... 112/102.5
5,855,176 A * 1/1999 Takenoya et al. ..... 112/102.5
5,865,133 A * 2/1999 Herbach et al. ..... 112/475.19
6,000,350 A 12/1999 Koike et al.
6,161,491 A * 12/2000 Takenoya et al. ..... 112/102.5
6,167,822 B1 * 1/2001 Miyasako et al. ..... 112/102.5

* cited by examiner

*Primary Examiner*—Gary L Welch
*Assistant Examiner*—Nathan E Durham
(74) *Attorney, Agent, or Firm*—Venable LLP; Eric J. Franklin

(57) ABSTRACT

A method and an arrangement for placing an embroidery in the desired position on a sewing material for embroidering on a sewing machine which has a memory for embroidery elements and a processor for reading stitch data for a selected embroidery element and for manoeuvring the sewing machine to execute stitches associated with the selected embroidery element on the sewing material, in which pattern points are assigned to the embroidery element and registered in the processor, and in which fabric points are marked on the sewing material at points where corresponding pattern points are to be located when embroidering, the sewing machine processor automatically orienting and scaling executed patterns of the embroidery element on the sewing material.

9 Claims, 2 Drawing Sheets

POSITIONING OF EMBROIDERY

CROSS-REFERENCE TO RELATED APPLICATIIONS

This application claims priority to Swedish patent application 0501249-7 filed Jun. 1, 2005.

TECHNICAL FIELD

The present invention relates to an arrangement and a method for a sewing machine. In particular the invention demonstrates an arrangement and a method for correctly placing, orienting and scaling an embroidery on a fabric when sewing an embroidery, stored in a memory, by means of the sewing machine.

PRIOR ART

Executing embroideries by means of a sewing machine, in which the embroidery is stored in a memory that contains stitch data for the embroidery, is already known. An operator selects an embroidery from the memory and places a sewing material, on which the embroidery is to be executed, stretched out on an embroidery frame, which is arranged on the sewing machine in such a way that a control program for the sewing machine mechanically moves the embroidery frame according to the control program and stitch data for executing the embroidery on the sewing material. The sewing material is usually a fabric, which term will henceforward be used as an example to denote all types of sewing material.

When a pattern is to be embroidered in a certain position on the fabric, the operator places a marking on the fabric so that this marking is visible inside the embroidery frame. The operator then moves the frame so that the needle of the sewing machine is brought to coincide with the marking, the movement made being registered in the sewing machine processor, so that the selected embroidery can be executed with the chosen marking as the starting point. An example of such a prior art is shown in the document U.S. Pat. No. 6,000,350. The content of said documents is hereby incorporated in its entirety into the present description.

The operator often wishes to place a certain pattern in a certain position on a piece of fabric, for example a strip of text or an attractive image over a pocket on a garment. In the prior art the operator has to manually adjust the position, size and rotation of the pattern in order to get the pattern to fit on the garment as intended. The manual adjustment is time-consuming, since adjustments have to be made in several stages with small changes at each stage.

Another difficulty arises when the operator wishes to sew the same pattern a number of times in succession, the fabric having to be retensioned on the frame between each operation. This is done, for example, in order to be able to produce large embroideries on a surface of the fabric which is situated outside the area that is accessible within the embroidery frame, as is the case, for example, with embroidery on runners or large tablecloths. When doing this it is essential that the pattern that is to be embroidered is correctly positioned and aligned with parts of the overall embroidery sewn earlier, in order that the overall result will look like a single embroidery.

The difficulties inherent in the prior art are most manifest where a pattern that is to be embroidered by means of the sewing machine does not readily lend itself to marking on the fabric. The operator cannot himself select the point on the pattern that is to serve as starting point for the embroidery. Nor can the orientation of the pattern, that is to say the angle at which the pattern must be rotated on the fabric, be easily determined by the operator. A further difficulty arises if the operator wishes to adjust the size of the chosen pattern lengthwise and/or widthwise.

The convenience of a freely selected starting point for the pattern becomes most apparent when the point associated with the pattern and stored in the memory lies inside an area of the embroidery that does not have any pronounced characteristics, for example where the embroidery is to start from a point which lies inside a flower petal for an embroidery that consists of a flower. For certain patterns the starting point for the embroidery may lie outside areas that are to be embroidered.

An object of the present invention is to provide an arrangement and a method for avoiding the problems indicated and in this way to permit a free choice of starting point for the embroidery and to further facilitate the orientation and scaling of an embroidery from a pattern.

DESCRIPTION OF THE INVENTION

The invention can be implemented in a sewing machine in various ways. The present description describes the embroidery of patterns on an embroidery sewing machine according to the invention, in which the sewing machine can be adjusted by the operator for placing an embroidery on the sewing material (the fabric) according to at least two modes. These modes are hereinafter denoted as first mode, mode1, and a second mode, mode2.

In the first mode existing embroidery elements are used, which are provided in the form of ready-programmed embroidery elements stored in an internal memory of the sewing machine or fed into the sewing machine from an external memory unit. These existing embroidery elements are provided in various geometric configurations having defined boundary lines and corners, the embroidery elements consisting, for example, of rectangular, triangular or some other polygon containing an embroidery pattern. Adjusting the embroidery element on a sewing material, thereby allowing any of the corners of the embroidery element to be set to form the points of the pattern D1, D2 or D3 as described, makes it easy to turn the embroidery element as required on the fabric and if so desired to scale the embroidery element lengthwise and/or widthwise (lengthwise here relates to the extent along a base line formed by one of the boundary lines for the embroidery element and widthwise relates to a direction that is perpendicular to the selected base line).

In the prior art an available embroidery element usually has a point from which the embroidery starts. This point may be a certain stitch (usually the first stitch) or a co-ordinate within the defining area of the embroidery element (for example a corner or the centre of the smallest rectangle enclosing the embroidery element). As stated, this starting point may be defined within a field that is to be embroidered with stitches in the embroidery element, or even outside the field that is to be embroidered with stitches. In these cases it is difficult for the operator to specify the precise co-ordinates for its corresponding point on the sewing material, that is to say where on the sewing material the starting point for the embroidery is to be placed. By using the second mode for placing the embroidery element on the sewing material (the fabric), the operator can himself select certain stitches in the embroidery element which are to constitute pattern points D1, D2 and D3 for defining the placing of the embroidery element on the fabric. The operator can thereby select highly significant points in the pattern of the embroidery element, such as a corner of a letter, the end of a line or the tip of a geometric field in the pattern, for example the outermost tip of a flower petal. Points of this type are easy to select and belong to the points which the operator can easily identify before marking their desired position on the fabric (that is to say the points which here in the description have been named with fabric points).

The invention therefore provides a solution in which a sewing machine has been equipped with means so that the sewing machine automatically adjusts the position, size and rotation of a selected embroidery element in such a way that the embroidery will fit into an available area on the fabric without the sewing machine operator needing to retension this or to position it manually or alter the size of the pattern.

Further characteristics of the present invention are demonstrated in the following detailed description, which is to be interpreted in association with the drawings attached. It must be emphasized that the drawings are given solely for the purpose of illustration and do not limit the invention. The drawings are not drawn to scale and only show the underlying concept of structures and procedures described herein.

DETAILED DESCRIPTION OF EMBODIMENTS

A number of embodiments of the invention will be described below with reference to the drawings attached.

Figure 1A:
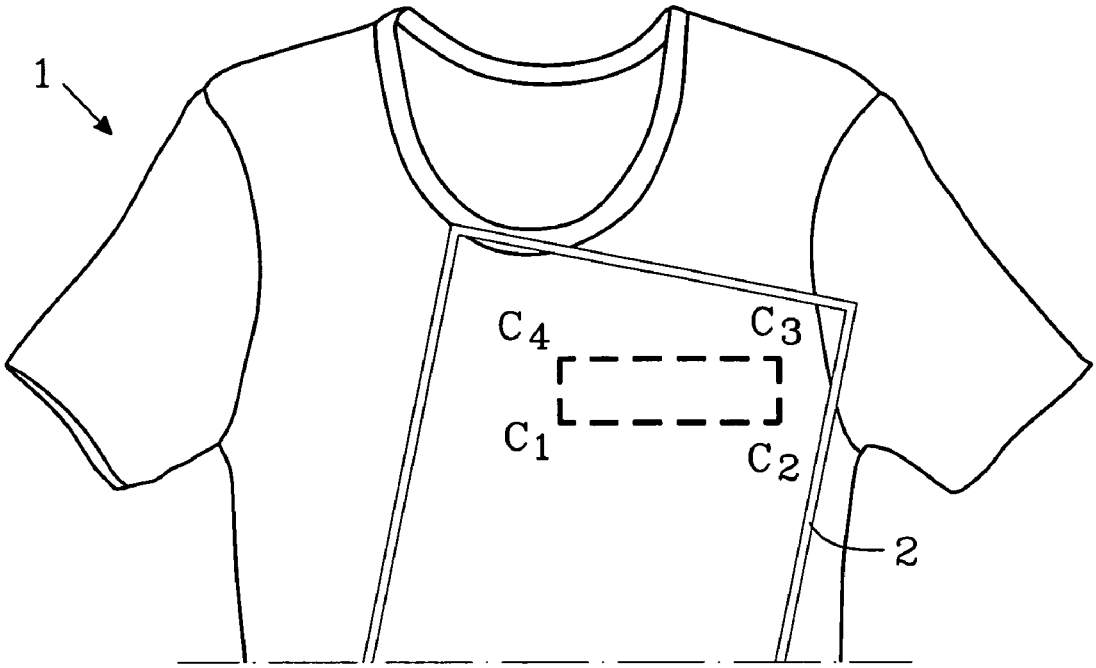
FIG. 1*a* shows a fabric that is to be embroidered, the fabric being stretched on an embroidery frame and points being marked which indicate how an embroidery element is to be oriented on the fabric.
Figure 1B:
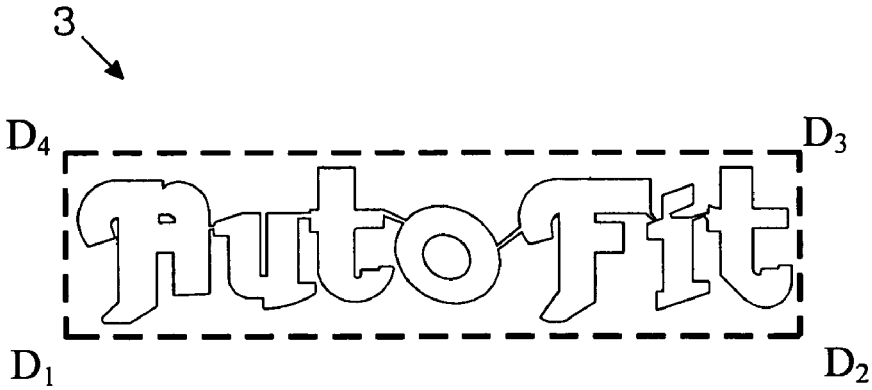
FIG. 1*b* shows a pattern with reference points (pattern points) of an embroidery element, which is to be placed on the marked position according to FIG. 1*a*.

FIG. 1*a* shows an example of how mode1 can be used in an embroidery machine for placing a selected embroidery pattern that is to say oriented to a desired position on a garment 1, such as a sweater according to the drawing. The part of the fabric of the garment 1 where the embroidery is to be executed is stretched on an embroidery frame 2 and is connected to the sewing machine in a known manner. The sewing machine operator selects an embroidery element 3 that is either retrieved from the memory of the sewing machine or is read in from an external memory. An example of a selected embroidery element 3 is shown in FIG. 1*b*. Using boundary lines or corners, the operator marks where on the garment the embroidery element 3 is to be placed, so that an embroidery with the pattern as specified by the embroidery element ends up within the confines specified by the operator. FIG. 1*a* shows co-ordinates which the operator has specified for corners of the embroidery element. The corners which on the garment 1, that is to say the fabric, must be matched by corners of the embroidery element are denoted by C1, C2, C3, C4. As will be shown, it will suffice for the operator to specify two points, in this case C1 and C2, in order for the embroidery element to end up in the correct position and with the correct orientation on the fabric.

In FIG. 1*b* the corners of the embroidery element 3 are referred to as D1 to D4 and in this description are called pattern points.

According to the mode, mode 1, the operator is required to select a first corner as the first pattern point D1. In this case the bottom left-hand corner is selected as the first pattern point D1. The operator is then required to move the embroidery frame 2 lengthwise and widthwise until the sewing machine needle is placed exactly over the first fabric point C1, which is confirmed to the sewing machine control program (in the processor) by a confirmation from the operator to the control program. During the movement the sewing machine processor is fed with data, that is to say with the co-ordinates as the embroidery frame 2 is moved lengthwise and widthwise. The control program is hereby now coded in order to move the corner D1 of the embroidery element to point C1 on the fabric. If, in this position, the operator wishes the sewing machine to rotate the pattern, the control program requires the operator to select a further corner, in this case exemplified by the lower right-hand corner of the embroidery element, as the second pattern point D2. The operator moves the embroidery frame 2 once again so that the needle will be placed exactly over the second fabric point C2 and confirms this second position to the control program.

Performing these steps gives the sewing machine control program sufficient information to place pattern point D1 of the embroidery element on fabric point C1 of the fabric and to rotate the pattern (that is to say the entire embroidery element) in such a way that the line D1D2 of the embroidery element will be placed on the line C1C2 on the fabric for embroidering. The processor in the sewing machine automatically performs the calculations required in order to produce the rotation. This is done by means of common geometric calculations and will not be described here.

In this situation the operator also has an option to scale the entire pattern of the embroidery element lengthwise. The operator can order this, for example, by specifying that pattern point D2 on the fabric must be matched by fabric point C2. The distance C1C2 will thereby be shorter, longer or equal to the corresponding distance D1D2 of the pattern, depending on where the operator places the fabric point C2. The processor here calculates a scaling factor which consists of the ratio between the distances C1C2 and D1D2. This scaling factor is then used for a scaling of all dimensions in the longitudinal direction of the pattern when embroidering this on the fabric.

If so desired, the pattern can also be scaled widthwise. In this situation there is the facility to select a third pattern point D3 of the embroidery element which specifies the height of the pattern in relation to a base line consisting of the perpendicular from the point D3 to the line through points D1 and D2. When the embroidery element comprises a figure in which the height is given, such as square, a rectangle, a triangle etc, the height of the embroidery element may be given in the control program. The operator thus marks a third fabric point C3 on the fabric, which then indirectly specifies the height for the actual, resulting embroidery of the pattern according to the embroidery element. The position of the fabric point C3 is then correspondingly fed into the control program by moving the embroidery frame 2 so that the needle is placed exactly over the fabric point C3, where this position is confirmed to the control program, so that the co-ordinates for the fabric point C3 will be known. The control program can hereby calculate the scaling widthwise, that is to say by what scaling factor the height of the pattern on the embroidery element must be scaled widthwise on the fabric when embroidering. The sewing machine processor calculates said heights according to ordinary geometry. The scaling factor will here consist of the ratio between the perpendicular distance from point C3 to the line that runs through points C1 and C2 and the distance from pattern point D3 to the line that runs through points D1 and D2 on the embroidery element.

Figure 2A:
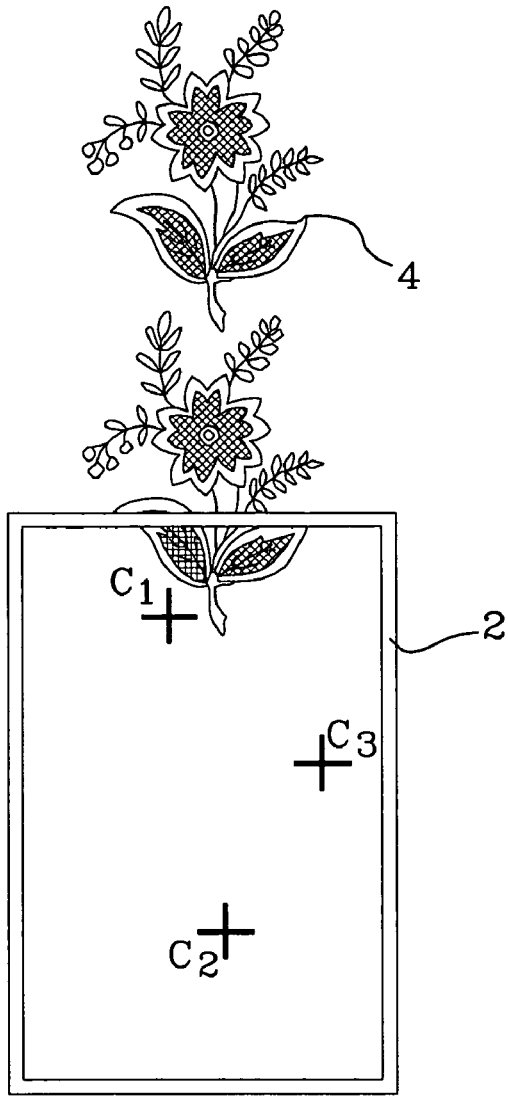
FIG. 2*a* shows a fabric that is to be embroidered, the fabric being stretched on an embroidery frame and points being marked which indicate how a pattern from an embroidery element is to be oriented on the fabric.

An alternative method for ensuring that a pattern from an embroidery element is correctly placed on a piece of fabric when embroidering with the sewing machine is described below. This alternative is described as using a second mode, mode2, for embroidering and its use is specific to cases in which a number of patterns are to be laid out on a piece of fabric for embroidering. Such an example is given in FIG. 2*a*, which shows a recurring pattern in the form of a flower that is repetitively embroidered on a fabric, for example. In theses cases it is easier to select certain corners, or points on the pattern which it is intended to locate on certain pre-selected points on the fabric. In the example according to FIG. 2*a* a fabric is stretched on an embroidery frame 2. A pair of identical flowers 4 are already embroidered in a row and the operator wishes to embroider a further identical flower 5 (FIG. 2*b*) in the row. The operator has therefore already previously indicated that certain points of the flower in the pattern are to be placed on points C1 to C3 represented in FIG. 2*a*.

By, for example, displaying the embroidery element on a screen, a display or the like, the operator, using a pointer or a hairline, for example, can select certain stitches in the pattern which are reproduced on the embroidery element and thereby use then as pattern points, which must be matched by fabric points on the fabric. An example of this is given in FIG. 2*b*, in which an embroidery pattern in the form of the flower 5 has been given the pattern points D1, D2 and D3. D1 and D3 are easily defined points in that they are the outermost tips of flower petals and D2 is the bottom point of the flower stalk.

When using mode2 the sewing machine processor requires the first pattern point D1 to be fed in, following which the operator confirms the selection of first pattern point to the control program. In a manner corresponding to mode1 the operator now moves the embroidery frame 2 by means of the sewing machine embroidery frame feed mechanism as the control program registers the movement to the first fabric point C1 and confirms to the program that the needle is placed exactly over the selected fabric point C1. When embroidering the pattern the sewing machine control program will now place the selected first pattern point D1 on the position for the selected fabric point C1.

If the operator wants an automatic rotation of the pattern, mode2 affords the facility for aligning the pattern according to the embroidery element with the desired orientation on the fabric by adding a further pattern point, a second pattern point D2, of the pattern, as shown in the example of the flower pattern above. The operator again moves the embroidery frame 2 so that the needle will be placed exactly over the second fabric point C2, and confirms this second position to the control program.

Performing these steps gives the sewing machine control program sufficient information to place pattern point D1 of the embroidery element on fabric point C1 of the fabric and to rotate the pattern (that is to say the entire embroidery element) in such a way that the line D1D2 of the embroidery element will be placed on the line C1C2 of the fabric for embroidering. The processor in the sewing machine automatically performs the calculations required in order to produce the rotation. This is done by means of common geometric calculations and will not be described here.

Figure 2B:
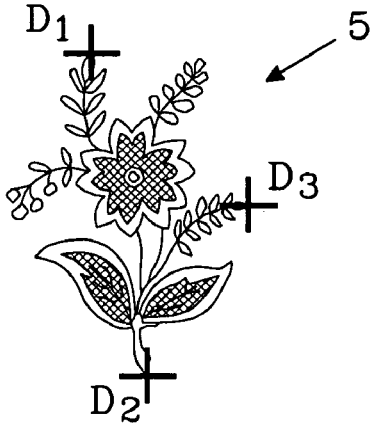
FIG. 2*b* shows a pattern that is used in FIG. 2*a* and illustrates selected reference points on the pattern (pattern points)

As in the case of mode1, the operator has an option to select scaling of the pattern along a base line passing through pattern points D1 and D2, here termed the lengthwise direction. Scaling can also be performed in a direction perpendicular to the base line, here termed the widthwise direction. Scaling lengthwise only requires marking of the points C1 and C2 on the fabric (corresponding to the selected pattern points D1 and D2 on the embroidery element). When the widthwise scaling option is selected, the program requires the operator to feed in a further point. A third pattern point D3 selected in this way is shown in FIG. 2*b*. A corresponding third fabric point C3 is marked on the fabric as the point on which the third pattern point D3 is to be placed for actual embroidering of the pattern. A scaling factor for lengthwise and widthwise scaling is calculated here (using mode2) in the same way as when calculating corresponding scaling factors in mode1.

The operator also has a facility for arrangement so that the pattern depicted on an embroidery element is executed sloping when embroidering the pattern on the fabric. This is automatic when the scaling factor over the distance C1C2 is 1:1, that is to say when transferring this to the fabric produces no reduction of the distance D1D2 and where the further fabric point C3 is set to another position relative to points C1 and C2 other than the relative position which the corresponding pattern point D3 occupies in relation to points D1 and D2 on the embroidery element.

Although the present invention has been described in connection with specific embodiments it is not intended to be limited to the specific form(s) in which they have been represented in this description. In reality the scope of the present invention is only limited by the following patent claims. In the claims, such terms as comprising or including do not exclude the presence of other elements or steps. Furthermore, although not individually listed, a plurality of arrangements, elements or steps in the method may be implement in a single unit, for example. In addition, although individual characteristics may be included in different patent claims, these may feasibly be advantageously combined and the inclusion in different patent claims does not means that a combination of characteristics is not suitable and/or advantageous. Singular references moreover do not exclude a plurality. References to "one", "first", "second" etc. therefore do not preclude the existence of a plurality, unless this is explicitly emphasized. Reference numerals in the patent claims are only provided as elucidatory examples and must not be interpreted as limiting the scope of the patent claims in any way.

The invention claimed is:

1. A method for placing an embroidery in the desired position on a sewing material for embroidering on a sewing machine which has a memory for embroidery elements and a processor for reading stitch data for a selected embroidery element and for manoeuvring the sewing machine to execute stitches associated with the selected embroidery element on the sewing material, in which the sewing machine comprises:

a needle which is set into a reciprocating movement primarily along a perpendicular to the sewing material, an embroidery frame on which the sewing material is stretched, and the processor which controls movements of the embroidery frame lengthwise and widthwise in relation to the needle position and synchronously with the movement of the needle in order to execute the embroidery according to the embroidery element selected, the method comprising:

assigning a first pattern point D1 to the embroidery element and registering the first pattern point in the processor;

assigning a second pattern point D2 to the embroidery element and registering the second pattern point in the processor;

marking a first fabric point C1 on the sewing material;

marking a second fabric point C2 on the sewing material;

moving the embroidery frame to a position in which the needle position coincides with the first fabric point C1, the movement being registered by the processor so that the processor in executing the embroidery uses the position for the first fabric point C1 on the sewing material as the position for the first pattern point D1 in the embroidery element; and moving the embroidery frame to a position in which the needle position coincides with the second fabric point C2, the movement being registered by the processor so that the processor in executing the embroidery rotates the embroidery element so that a line, which on the embroidery element runs through the first pattern point D1 and the second pattern point D2, coincides with a line that runs through the first fabric point C1 and the second fabric point C2 on the sewing material.

2. The method according to claim 1, further comprising:

setting the first pattern point D1 to be a first predefined corner point of the embroidery element; and setting the second pattern point D2 to be a second predefined corner point of the embroidery element.

3. The method according to claim 2, further comprising:

controlling the sewing with the processor in executing the embroidery so that the second pattern point D2 is made to coincide with the second fabric point C2, the processor calculating a scaling factor by which the embroidery element in the embroidering is scaled in the direction of the line C1C2; and setting the scaling factor to the ratio (C2-C1)/(D2-D1).

4. The method according to claim 2, further comprising:

setting a third pattern point D3 to be constituted by a third predefined corner point in the embroidery element; and marking a third fabric point C3 on the sewing material in order to mark the position for placing of the third pattern point D3 for embroidering of the embroidery element, the processor calculating a scaling factor by which the embroidery element in the embroidering is scaled in the direction defined by the perpendicular from the third fabric point C3 to the line through the first fabric point C1 and the second fabric point C2; and setting the scaling factor to the ratio between the distance from the third fabric point C3 to the line C1C2 and the distance from the pattern point D3 to the line D1D2.

5. The method according to claim 4, further comprising:

displaying an image of the embroidery element on a screen, pattern points D1, D2, D3 being defined by the operator for registering in the processor.

6. The method according to claim 1, further comprising:

setting the first pattern point D1 to be matched by the position for a first stitch in the embroidery element selected by the operator; and setting the second pattern point D2 to be matched by the position for a second stitch in the embroidery element selected by the operator.

7. The method according to claim 6, further comprising:

in executing the embroidery the processor controls the sewing so that the second pattern point D2 is made to coincide with the second fabric point C2, the processor calculating a scaling factor by which the embroidery element in the embroidering is scaled in the direction of the line C1C2; and the scaling factor is set to the ratio (C2-C1)/(D2-D1).

8. The method according to claim 7, further comprising:

setting a third pattern point D3 to be matched by the position for a third stitch in the embroidery element selected by the operator;

marking a third fabric point C3 on the sewing material in order to mark the position for placing of the third pattern point D3 for embroidering of the embroidery element, the processor calculating a scaling factor by which the embroidery element in the embroidering is scaled in the direction defined by the perpendicular from the third fabric point C3 to the line through the first fabric point C1 and the second fabric point C2; and setting the scaling factor to the ratio between the distance from the fabric point C3 to the line C1C2 and the distance from the pattern point D3 to the line D1D2.

9. A sewing machine for performing a method for placing an embroidery in a desired position on a sewing material, the sewing machine comprising:

a control program which registers the position on the embroidery element for a first pattern point D1 and a second pattern point D2, which are fed into the program by an operator;

wherein the control program is designed to register a movement of the embroidery frame lengthwise and widthwise when the operator places the needle exactly over a marked first fabric point C1 and a marked second fabric point C2;

wherein the control program is designed to perform calculations in order to place the first pattern point D1 on the first fabric point C1 and to orient the embroidery element so that a line through pattern points D1 and D2 is located on a line through fabric points C1 and C2; and wherein the control program is designed to perform calculations in order to determine a scale factor for the embroidery element to be sewn to a ratio (C2-C1)/(D2-D1).

* * * * *